US005463949A

United States Patent [19]

Maehara et al.

[11] Patent Number: 5,463,949

[45] Date of Patent: Nov. 7, 1995

[54] GRAVURE PRESS WITH IMPROVED PRINTING DRUM ARRANGEMENT

[75] Inventors: Kenso Maehara, Hiroshima; Osamu Majima; Shigeyoshi Hirashima, both of Tokyo, all of Japan

[73] Assignees: Ryobi Ltd.; Sony Co., both of Japan

[21] Appl. No.: 298,193

[22] Filed: Aug. 31, 1994

[30] Foreign Application Priority Data

Aug. 31, 1993 [JP] Japan ..... 5-215837

[51] Int. Cl.[6] ..... B41F 9/02

[52] U.S. Cl. ..... 101/152; 101/170

[58] Field of Search ..... 101/152, 153, 101/174, 154, 155–157, 170, 216, 232

[56] References Cited

U.S. PATENT DOCUMENTS 1,705,081 3/1929 Wilhelm ..... 101/152

3,949,670 4/1976 Katsuji ..... 101/183

4,934,714 6/1990 Cynch ..... 101/415.1

*Primary Examiner*—J. Reed Fisher

*Attorney, Agent, or Firm*—Merchant, Gould, Smith, Edell, Welter & Schmidt

[57] ABSTRACT

Prevention of damages on the printing surface of plastic gravure plate is the object. Radius of the plate cylinder 14, impression cylinder 11, and transfer drum 2 located between units are identical. The plate cylinders 14, 24 and the impression cylinders 11, 21 are arranged so that the lines L1 and L2 are parallel to each other. The grippers 12, 22 are arranged so that the gripper 22 of the impression cylinder 21 is at the point $P_{21}$ when the gripper 12 of the impression cylinder 11 is at the point $P_{11}$. Thus, a paper sheet transferred from the impression cylinder 11 to the transfer drum 2 at the nearest point $P_1$ is transferred by the rotation of the transfer drum 2 at the nearest point $P_2$ by the rotation of the transfer drum 2. Since the phases of the plate cylinders 14 and 24 are in agreement, the doctor blade is stopped at the same relative location for all the units.

12 Claims, 8 Drawing Sheets

GRAVURE PRESS WITH IMPROVED PRINTING DRUM ARRANGEMENT

BACKGROUND OF THE INVENTION

1. Technical Field of the Invention

This invention relates to a multi-color gravure press, and more particularly to the arrangement of printing drums thereof.

2. Related Art

A conventional multi-color press 71 will be described in reference to FIG. 1. The multi-color press 71 performs printing as described below by means of a first unit 10 and a second unit 20.

First, a paper sheet 34 is fed by a feeder section 73 to an impression cylinder 72. In the first unit 10, a plate cylinder 14 has a metallic gravure plate 13 wound thereon so that ink stored in an ink pan 18 adheres to the surface of the gravure plate 13 as an ink roller 16 rotates. This causes a concave pattern formed on the gravure plate 13 to be filled with ink. Surplus ink adhering to the surface of the gravure plate 13 is scraped off by a doctor blade 17.

Printing onto the paper sheet 34 fed to the impression cylinder 72 is performed one by one with ink stored in the concave pattern of the gravure plate 13 at the nearest point between the impression cylinder 72 and the first plate cylinder 14.

In the second unit too, printing in a different color is performed in a similar manner. In order to compensate phase difference between printing surfaces of the first and second units, the gravure plates are wound with a phase difference from each other corresponding to the phase difference described above.

When printing in the second unit is over, the printed paper sheet 37 is removed from the impression cylinder 72, transferred through a delivery roller 41, a delivery chain 39 and a delivery roller 42, and stacked in a delivery section.

The conventional gravure press 71 as described above, however, has disadvantages as described below.

With the multi-color gravure press using plastic material for the gravure plates, it is possible that damages are caused on the surfaces of the gravure plates. The cause of such damages is as follows: As already described above, in order to compensate the phase difference between the printing surfaces of the first and second units, the gravure plates are wound on the plate cylinders with a phase difference from each other corresponding to the phase difference between the printing surfaces. As a result, when it is arranged that the doctor blade of the first unit does not stop on the printing surface of the gravure plate of the first unit, it is possible that the doctor blade of the second unit stops on the printing surface of the gravure plate of the second unit.

Another disadvantage is as follows: The distance between the point at which the doctor blade is in contact with the gravure plate and the nearest point between the plate cylinder and impression cylinder for one unit is different from the distance for the other unit. This causes difference in drying conditions of ink and it becomes difficult to obtain printed paper sheets of an identical quality. In particular, when the distance described above is large, the state of ink filling the concave pattern of the gravure plate is likely to change, and therefore the printing conditions become unstable and result in scatter in quality of the printed paper sheets.

SUMMARY OF THE INVENTION

The object of this invention is to provide a gravure press capable of eliminating the disadvantages as described above, preventing damages from being caused on plastic gravure plates, and minimizing scatter in printing quality.

A gravure press comprises a group of units, said group of units comprising a plurality of units, each of said units comprising a plate cylinder, an impression cylinder, ink feeder means, and a blade, said plate cylinder being provided with a plastic gravure plate wound thereon, said impression cylinder being the same in radius with said plate cylinder and having transfer gripper for transferring printing paper sheets, said ink feeder means supplying ink to said gravure plate wound on the plate cylinder, said blade being arranged to be in contact with the gravure plate for removing surplus ink adhering to said gravure plate, a transfer drum arranged between said impression cylinders of adjacent units and having a radius being an integer times the radius of said impression cylinder, said transfer drum being provided with transfer gripper device for transferring paper sheets for printing, said plate cylinders and impression cylinders being arranged so that a line vertically connecting the axes of the plate cylinder and the impression cylinder of a attention unit selected from said plurality of units each other is parallel to a line vertically connecting the axes of the plate cylinder and the impression cylinder of an upper unit adjacent above the attention unit each other, and said impression cylinder of said attention unit, said impression cylinder of said upper unit, and said transfer drum arranged between said two impression cylinders being arranged so that a paper sheet transferred at the nearest point between said impression cylinder of said attention unit and said transfer drum arranged adjacent to said attention unit is transferred at the nearest point between said impression cylinder of said upper unit and said transfer drum when said impression cylinder rotates by a number of turns obtained by dividing the radius of said transfer drum by the radius of said impression cylinder.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a schematic view of a gravure press 61 as another embodiment of this invention.

DETAILED DESCRIPTION OF THE INVENTION

1. Constitution of the Gravure press 1

Figure 1:
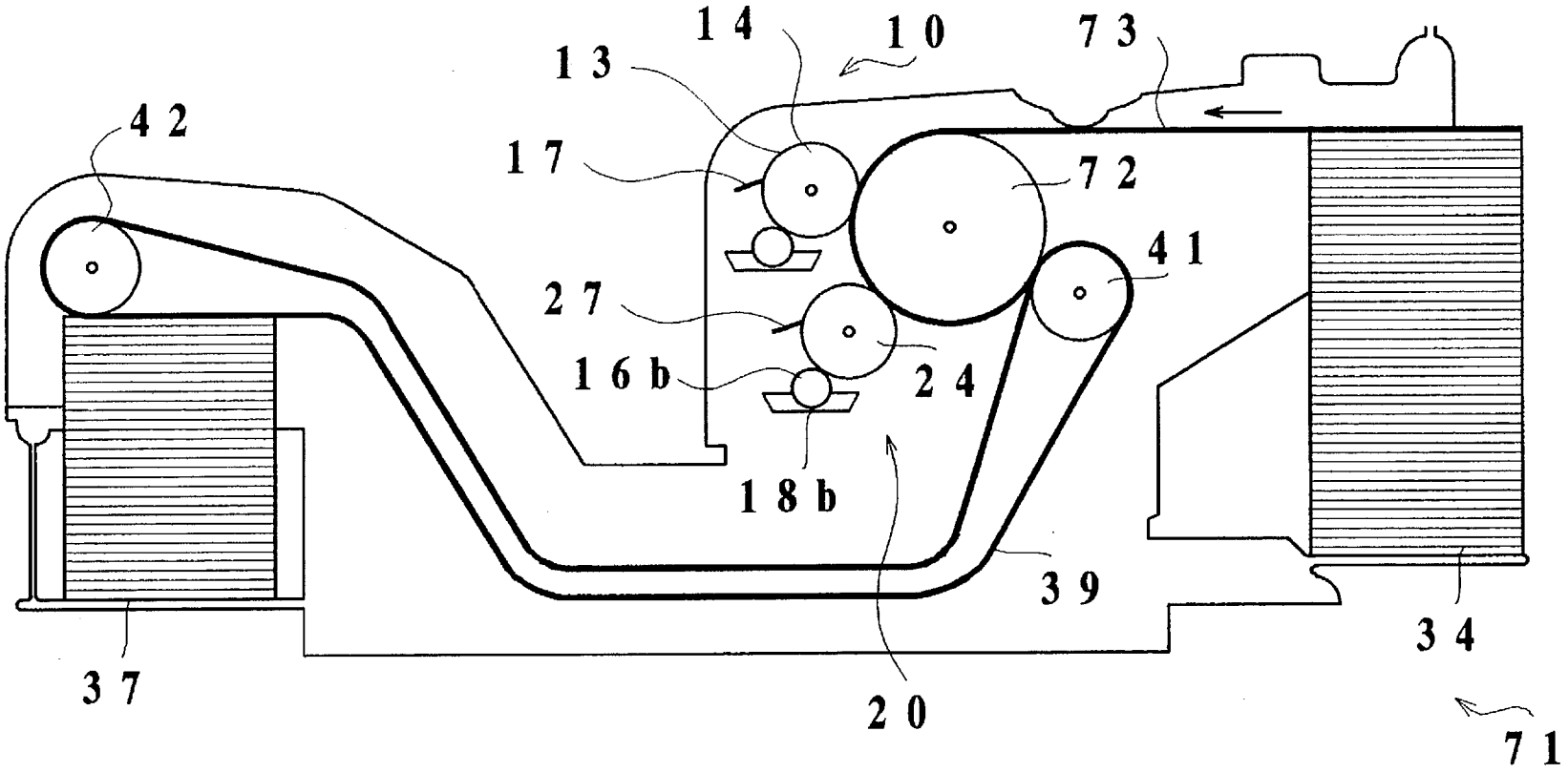
FIG. 1 (Prior Art)
FIG. 1 is a schematic view of a conventional multi-color gravure press 71.
Figure 2:
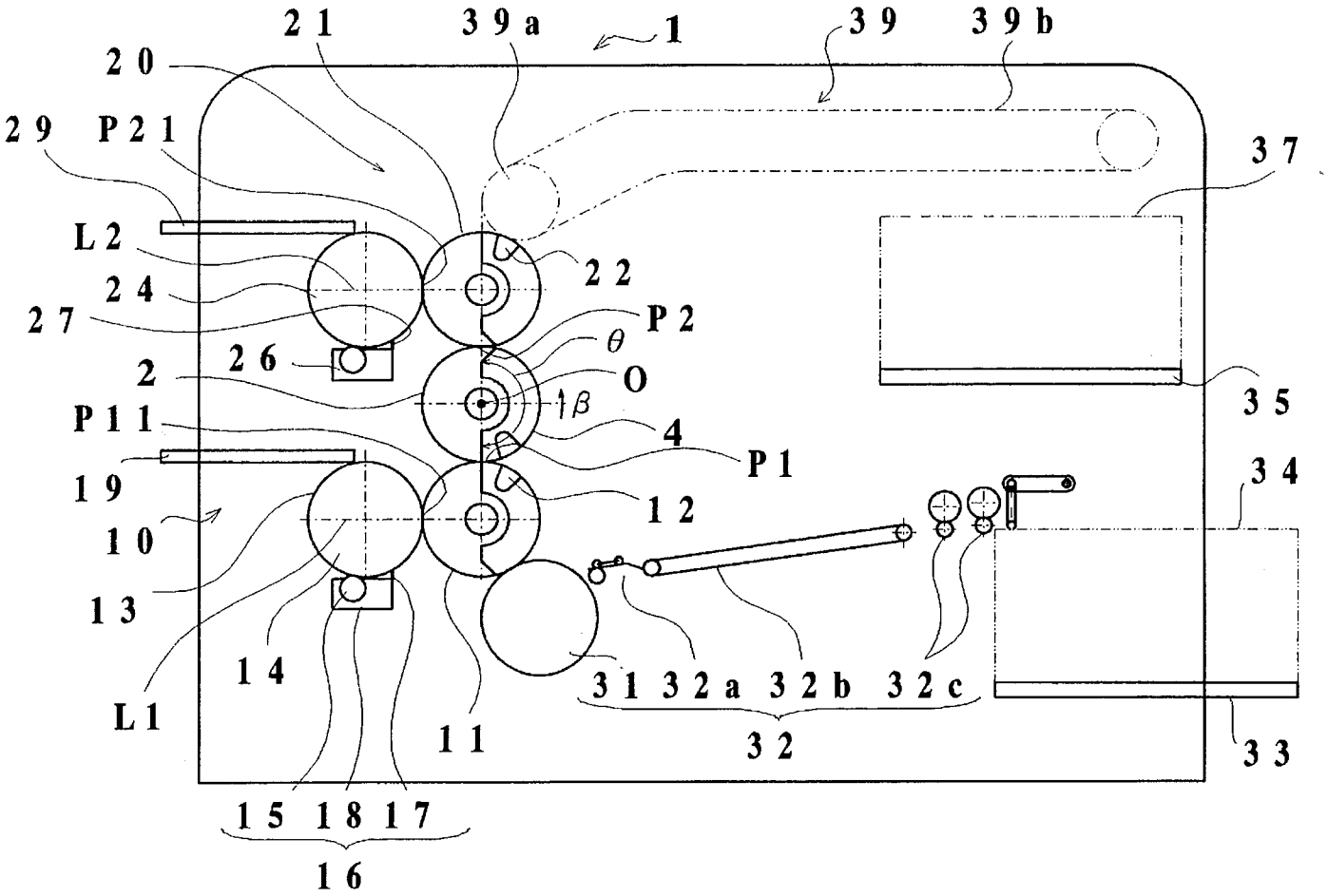
FIG. 2 is a schematic view of a gravure press 1 as an embodiment of this invention.

FIG. 2 shows a schematic view of a gravure press 1 as an embodiment of this invention. The gravure press 1 comprises a transfer drum 2, a first unit 10 as a unit, a second unit 20 as a unit, a paper sheet feed table 33 as a means for receiving paper sheets to be printed, a delivery table 35 as a means for receiving printed paper sheets, and a delivery unit as a means for transferring printed paper sheets. In this embodiment, the first and second units constitute a group of units.

The first unit comprises a plate cylinder 14, an impression cylinder 11, an ink feeder 16 as a means for supplying ink, a doctor blade 17 as a blade, and a guide section 19. A plastic gravure plate is wound around the plate cylinder 14. The gravure plate and the method of attaching it will be described later.

The impression cylinder 11 is provided with a gripper 12 as a transfer gripper device for transferring the paper sheets. The plate cylinder 14 and the impression cylinder 11 are of an identical radius.

The ink feeder 16 is arranged under the plate cylinder 14. The ink feeder 16 comprises an ink pan 18, and an ink roller 15. Ink stored in the ink pan 18 is applied on the surface of the gravure plate wound around the plate cylinder 14 when the ink roller 15 rotates. Ink is thus supplied to the gravure plate.

The doctor blade 17 is arranged to be in contact with the gravure plate wound around the plate cylinder 14 and to remove surplus ink adhering to the gravure plate. The arrangement of the ink feeder 16 under the plate cylinder 14 and the doctor blade 17 in the vicinity of the nearest point $P_{11}$ makes the state of ink stored in the concave pattern less likely to change, stabilizes printing, and reduces scatter in the quality of print.

The guide section 19, as will be described later, serves as a guide for automatically attaching the plastic gravure plate 13 onto the plate cylinder 14.

The second unit 20 is similarly constituted as the first unit 10. A transfer drum 2 is arranged between the impression cylinder 11 of the first unit 10 and an impression cylinder 21 of the second unit 20. The transfer drum 2 has a radius which is the same with that of the impression cylinders 11 and 12, and its surface is provided with a gripper 4 as a gripping transfer device for transferring the paper sheets.

The plate cylinder 14 of the first unit, the plate cylinder 24 of the second unit arranged as an upper unit just above the first unit, the impression cylinder 11 of the first unit, and the impression cylinder 21 of the second unit are arranged so that the line L1 vertically connecting the axes of the plate cylinder 14 and the impression cylinder 11 to each other is parallel to the line L2 vertically connecting the axes of the plate cylinder 24 and the impression cylinder 21 to each other. This brings the plate cylinders 14 and 24 into a state of phase agreement.

In the state of phase agreement, when a print start position of the gravure plate wound on the plate cylinder 14 is at the nearest point $P_{11}$ between the impression cylinder 11 and the plate cylinder 14 of the first unit, a print start position of the gravure plate wound on the plate cylinder 24 is at the nearest point $P_{21}$ between the impression cylinder 21 and the plate cylinder 24 of the second unit.

The impression cylinders 11, 21 of the first and second units, the transfer drum 2 located between the two cylinders, and the gripper 4 of the transfer drum 2 are arranged so that a paper sheet transferred at the nearest point P1 between the impression cylinder 11 of the first unit and the transfer drum 2 is further transferred by the rotation of the transfer drum 2 at the nearest point $P_2$ between the impression cylinder 21 and the transfer drum 2.

In this embodiment, since the transfer drum 2, and the impression cylinders 11, 12 are of an identical radius, it is arranged that $\theta=180$ degrees, where $\theta$ is the angle $P_1OP_2$ formed by the nearest point $P_1$, axis O of the transfer drum, and the nearest point $P_2$.

The arrangement described above causes the transfer of the paper sheet to be performed at the nearest points $P_1$ and $P_2$, with the plate cylinders 14 and 24 in phase agreement. As a result, when a printing machine is stopped so that a doctor blade does not stop on the printing surface of any one of the gravure plates, the doctor blades for all the gravure plates stop at positions other than on the printing surface. This prevents damages from occurring on the plastic printing surfaces.

Since the gravure plates of all the units are in phase agreement, drying conditions of ink can be made identical simply by placing the doctor blade 17 at identical phase positions so that print of identical quality is produced.

A paper feed table 33 is a table for receiving paper sheets yet to be printed as intended. A delivery table 35 is a table for receiving paper sheets already printed as intended. The paper feed table 33 and the delivery table 35 are arranged on the same side of the gravure press 1. In other words, the printed paper sheets are stacked on the side on which the paper sheets to be printed are stacked.

A paper feed unit 32 comprises a paper feed drum 31, a paper feed roller 32*a*, a paper feed belt 32*b*, and a paper feed roller 32*c*, and feeds paper sheets to be printed received on the paper feed table 33 to the first unit 10 which is the lowermost unit among a plural number of units described above.

A delivery unit 39 comprises a delivery sprocket 39*a*, and a delivery chain 39*b*, and transfers a printed paper sheet from the second unit which is the uppermost unit among the plural number of units described above to the delivery table 35 by means of a gripper (not shown) attached to the delivery sprocket 39*a*.

2. Operation of the Gravure press 1

Next the operation of the gravure press 1 will be described. A paper sheet to be printed 34 on the delivery table 33 is fed through the paper feed unit 32 to the impression cylinder 11. In the first unit 10, the printing paper sheet fed is gripped by the gripper 12 of the impression cylinder 11. Ink from the ink feeder 16 is supplied to the gravure plate of the plate cylinder 14. Surplus ink is removed by the doctor blade 17.

By the rotation of the impression cylinder 11 and the plate cylinder 14, printing by the first unit is performed at the nearest point $P_{11}$ between the impression cylinder 11 and the plate cylinder 14. When the rotation further proceeds and the gripper 12 of the impression cylinder 11 comes to a position opposite to the gripper 4 of the transfer drum 2, the paper sheet gripped by the gripper 12 is gripped by the gripper 4 of the transfer drum 2 at the nearest point $P_1$ between the impression cylinder 11 and the transfer drum 2 . Thus the paper sheet is transferred.

This transfer operation will be described below in reference to FIG. 8.

Figure 8A:
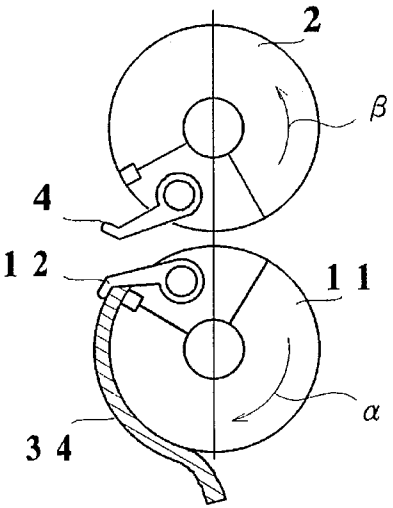
FIGS. 8A through 8F are views for disclosing the transfer of the printing paper sheet from the impression cylinder to the transfer drum.
Figure 8B:
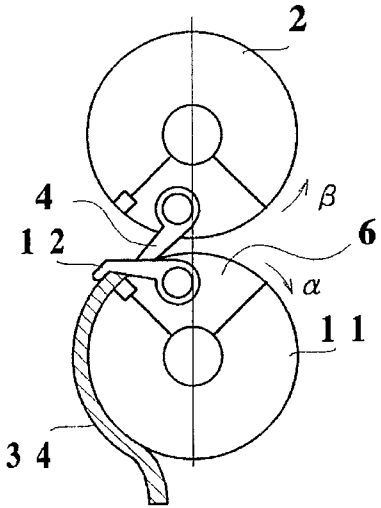
Figure 8C:
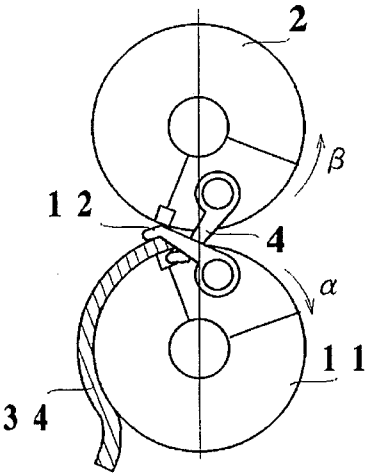
Figure 8D:
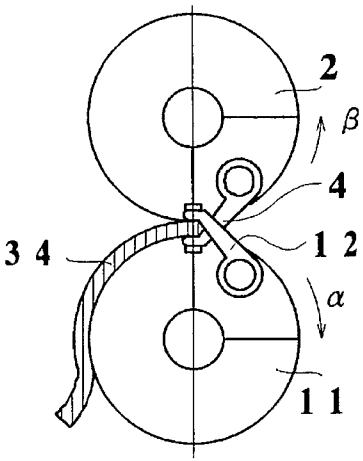
Figure 8E:
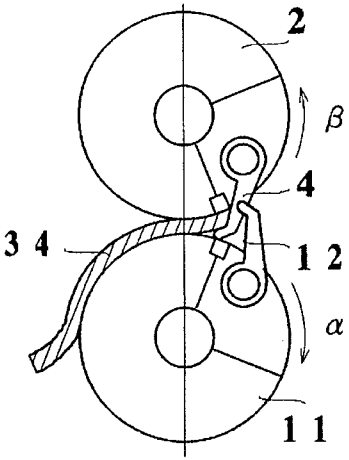
Figure 8F:
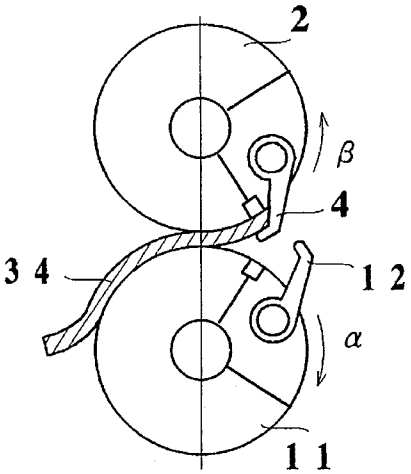

As shown in FIG. 8A, under the condition of the paper sheet 34 being gripped by the gripper 12 of the impression cylinder 11, the impression cylinder 11 is rotated in the direction of the arrow $\alpha$ and the transfer drum 2 is rotated in the direction of the arrow $\beta$. As a result, as shown in FIG. 8B, the gripper 4 of the transfer drum 2 enters a notch 6 on the impression cylinder 11. When the rotation of both components proceeds further, as shown in FIG. 8C, the gripper 4 comes to the back side of the paper sheet 34. When the rotation of both components proceeds further and both grippers 4 and 12 are located opposite to each other, as shown in FIG. 8D, the gripper 4 grips the paper sheet 34 from its back side. When the rotation further proceeds as shown in FIG. 8E, the paper sheet 34 is transferred from the gripper 12 to the gripper 4. When the rotation of both components proceeds further the paper sheet 34 is completely released from the gripper 12. Thus, the paper sheet is transferred from the impression cylinder 11 to the transfer drum 2.

Referring to FIG. 2, when the transfer drum 2 further rotates in the direction of the arrow β, the paper sheet 34 is transferred in a similar manner from the transfer drum 2 to the impression cylinder 21 of the second unit. Printing on the paper sheet 34 transferred to the impression cylinder 21 is performed by the second unit in a similar manner to that of the first unit at the nearest point P21 between the impression cylinder 21 and the plate cylinder 24. When printing is over at the second unit as the uppermost unit among the plural number of units, the paper sheet is sent by the delivery unit 39 to the delivery table 35. Since the paper feed table 33 and the delivery table 35 are on the same side, paper sheet loading operation onto the paper feed table 33 and the inspection at the delivery table can be made from the same side of the gravure press.

In particular, when printing in four colors or more is to be performed with the two-color press as shown in FIG. 2, although work of loading the printed paper sheet from the delivery table 35 onto the paper feed table 33 is required after changing ink, the work is easy because the paper feed table 33 and the delivery table 35 are on the same side.

3. Method of Attaching Gravure Plate

Next the method of attaching the gravure plate onto the plate cylinder 14 will be described in reference to FIGS. 3A and 3B.

First the gravure plate used in this embodiment will be described. A plate 50 with a break-away film comprising an adhesive agent layer 46 applied on the back side of the plastic gravure plate 13, and a break-away film 47 laminated over the adhesive agent layer 46 is prepared. When the end portion of the break-away film 47 of the plate 50 having the break-away film is separated, a bend 48 bent in a rounded V shape is formed as shown in FIG. 3A.

A groove 49 with a depth approximately the same with the thickness of the gravure plate 13 is formed in the direction of axes 45L, 45R of a cylinder 44 constituting the plate cylinder 14.

Next the method of automatically attaching the plate 50 having the break-away film onto the cylinder 44 of the plate cylinder 4 will be described in reference to FIG. 3A.

Figure 3A:
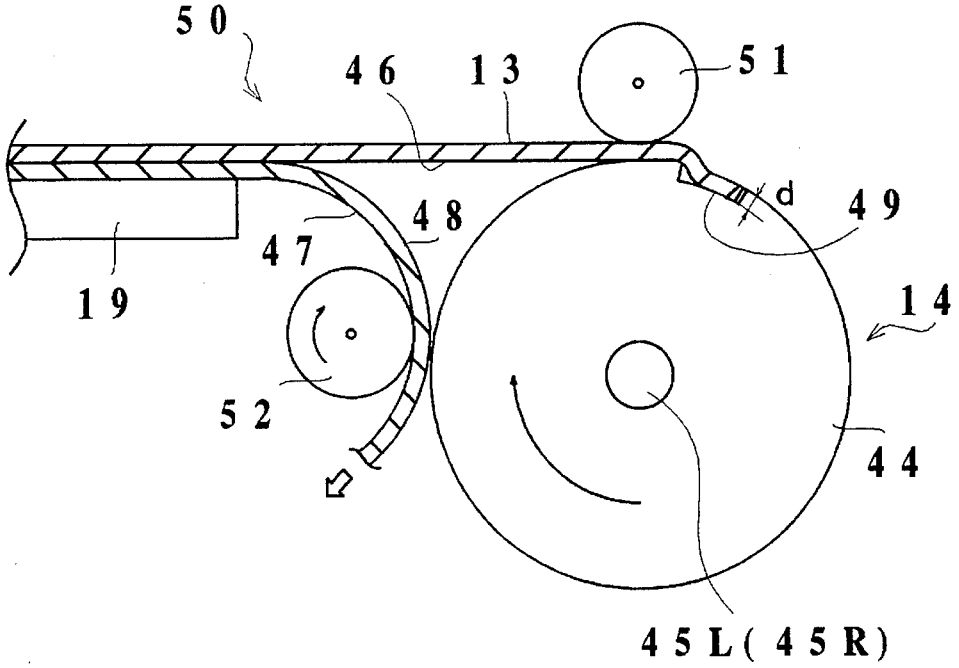
FIGS. 3A and 3B are detailed views of gravure plate attachment section of FIG. 1.
Figure 3B:
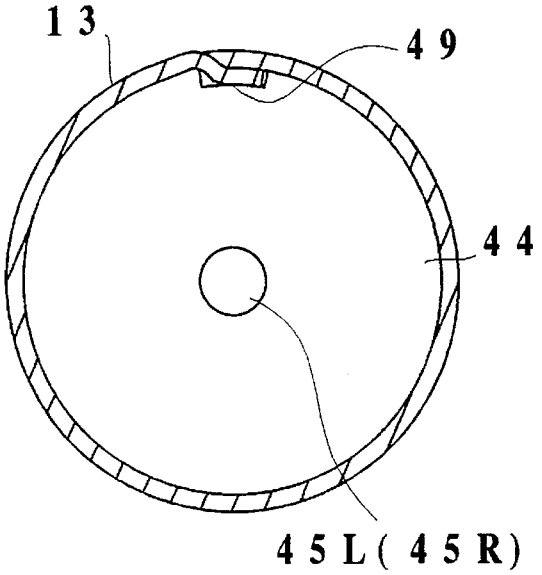

In FIG. 3A, the front end of the break-away film 47 of the film 50 placed on the guide section 19 is slightly separated. The front end of the gravure plate 13 is brought into engagement with the end of the groove 49 to set the plate 13 in position. The portion of the gravure plate 13 from which the break-away film 47 is separated is pressed against a cylinder 44 of the plate cylinder 14 by means of a plate guide roller 51. While pressing the gravure plate 13 against the cylinder 44 to prevent air from entering in between, the plate guide roller 51 is rotated freely.

The break-away film 47 separated and formed with the rounded V shape bend 48 on the other hand is pressed against the cylinder 44 of the plate cylinder 14 by means of a removal roller 52 made of rubber or the like. The removal roller 52 is rotated synchronously and in the same direction with the rotation of the cylinder 44 of the plate cylinder 14. The circumferential speed of the removal roller 52 is made equal to or slightly greater than that of the cylinder 44 of the plate cylinder 14. As a result, when the cylinder 44 of the plate cylinder 14 rotates, no slippage occurs between the break-away film 47 and the removal roller 52, but slippage occurs between the break-away film 47 and the cylinder 44. Therefore, the gravure plate 13 is wound automatically on the cylinder 44 of the plate cylinder 14 while the break-away film 47 is separated. The gravure plate 13 is finally wound on the cylinder 44 as shown in FIG. 3B.

This type of automatic arrangement is particularly easy to constitute in this embodiment because all the plate cylinder phases of the plural number of units are in agreement with each other.

While polyethylene is used as a plastic material for the gravure plate 13 in this embodiment, the material is not limited to that one but any thermoplastic material may be used as long as the material has a relatively narrow range of melting point, exhibits a certain hardness when solidified, and does not fly away or sublimate when melted. For example, acrylic resin may be used. The thickness of the plastic gravure plate employed in this embodiment is in the order of 200 micrometers.

4. Constitution of the Impression Cylinder and the Transfer Drum

Next the calculation of the angle θ described before will be described in reference to FIG. 7 under the assumptions of 1 through 5 enumerated below.

Assumption 1: Radius R of a transfer drum 65 is N times the radius r of impression cylinders 61, 63, where N is an integer.

Assumption 2: The grippers 4 are arranged at equal intervals over the circumference of the transfer drum 65.

Assumption 3: In an attention unit selected from the plurality units, the angle $P_1OP_2$ is assumed as θ, where the point $P_1$ is the nearest point between the impression cylinder 61 and the transfer drum 65, the point O is the axis of the transfer drum 65, and the point $P_2$ is the nearest point between the impression cylinder 63 of the unit located adjacent above the attention unit and the transfer drum 65.

Assumption 4: The angle $C_nOp_2$ is assumed as $\theta_2$, where the point $C_n$ is one of the grippers on the transfer drum 65 which passes first the nearest point $p_2$ when the transfer drum 65 rotates.

Assumption 5: Grippers of all units are positioned so that a gripper (b) is on the line vertically connecting the axes of the impression cylinder 63 and the plate cylinder 64 each other when a gripper (a) is on the line vertically connecting the axes of the impression cylinder 61 and the plate cylinder 62 each other.

Under the above assumptions, the angle θ is obtained as described below. From the assumption 5, a line L61 extending between the axis O61 and the gripper (a) of the impression cylinder 61 is parallel to a line L63 when an extension of the line L61 passes the axis O of the drum 65. An angle $\theta_3$ formed by three points; a gripper (b) of the impression cylinder 63, the axis O63 of the cylinder 63, and the point $P_2$; is expressed by the equation below, because the angles $\theta_3$ and θ are alternate angles.

$$\theta_3=\theta \tag{2}$$

When the transfer drum 65 rotates in the direction of the arrow α, and the impression cylinder 63 rotates in the direction of the arrow β, and when the transfer of a paper sheet is performed at the point $P_2$ by the grippers Cn and (b), an arc $x_{63}$ determined by the angle $\theta_3$ and an arc $x_{65}$ determined by the angle $\theta_2$ are expressed by the equation $$x_{63}=x_{65} \tag{3}$$

The equation (3) above is written as below using the radius R of the transfer drum 65, and the radius r of the impression cylinder 63.

$$r\theta_3/2=R\theta_2/2 \quad (4)$$

Since R=Nr from the assumption 1, the equation (4) is written as $$\theta_2=\theta_3/N \quad (5)$$

From the equations (2) and (5), $$\theta_2=\theta/N \quad (6)$$

From the assumption (2), $$\theta_2+\theta=2\pi/N \quad (7)$$

From the equations (6) and (7), $$\theta=2\pi/(N+1) \quad (8)$$

Although FIG. 7 shows magnifying view of the nearest point 1.

5. Regarding Other Gravure Presses

Figure 4:
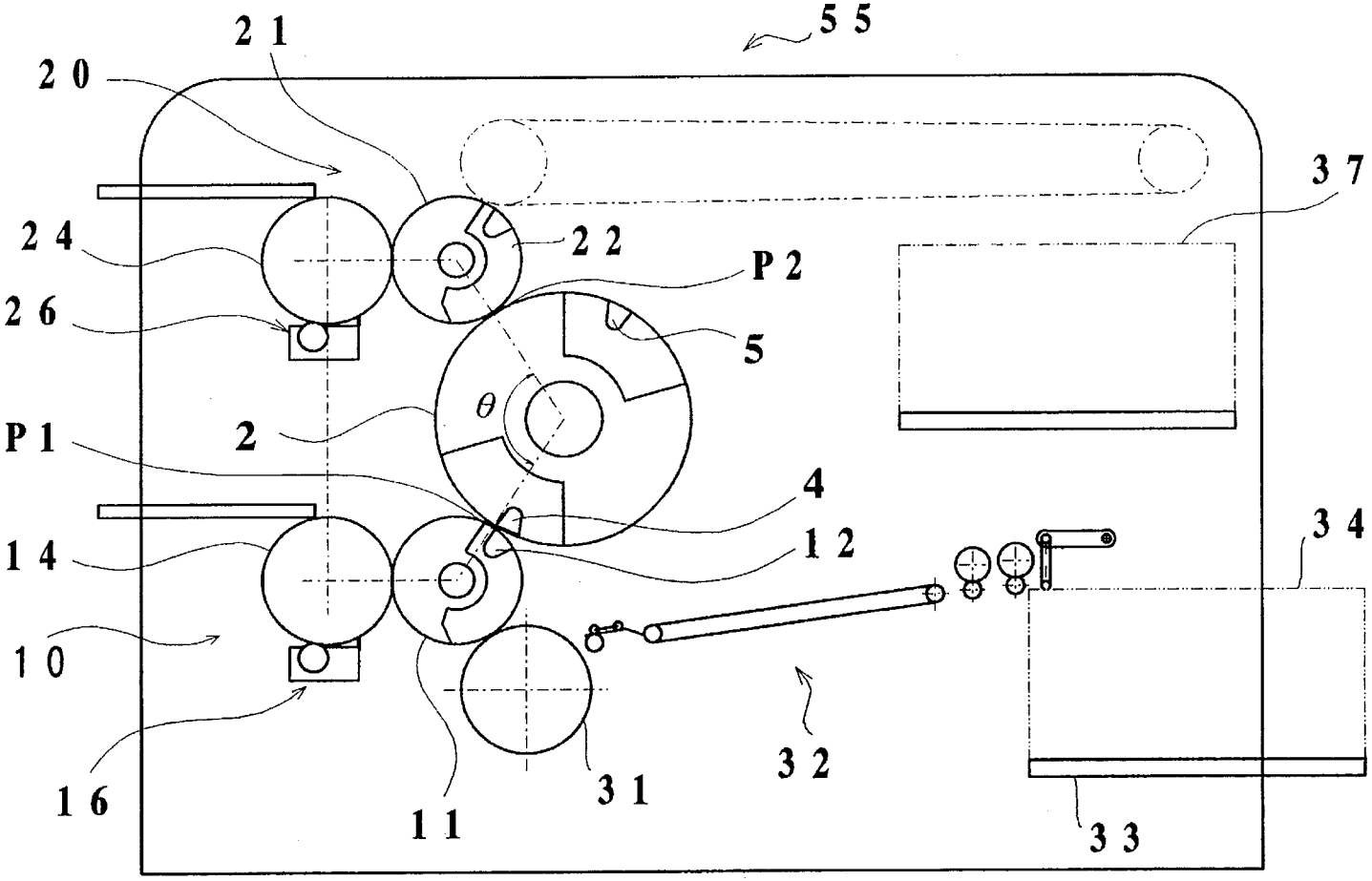
FIG. 4 is a schematic view of a gravure press 55 as another embodiment of this invention.

FIG. 4 shows a simplified structural view of a gravure press 55 as another embodiment. Since the transfer drum 2 of the gravure press 55 is constituted as a double-radius cylinder, structural relationship among the impression cylinders 11, 21, and the transfer drum 2 is as described below.

The transfer drum 2 is provided with two grippers 4 and 5 on the circumference of the transfer drum 2 at equal intervals. It is constituted that θ is 120 degrees, where θ is the angle $P_1OP_2$ formed by the nearest point $P_1$, the axis O of the transfer drum 2, and the nearest point $P_2$.

FIG. 5 shows a simplified structural view of a gravure press 61 as another embodiment. The gravure press 61 is the same with the gravure press shown in FIG. 4 except that it is provided with the first through fourth units to perform four-color printing. Since other structures remain unchanged, further description is omitted.

Figure 6:
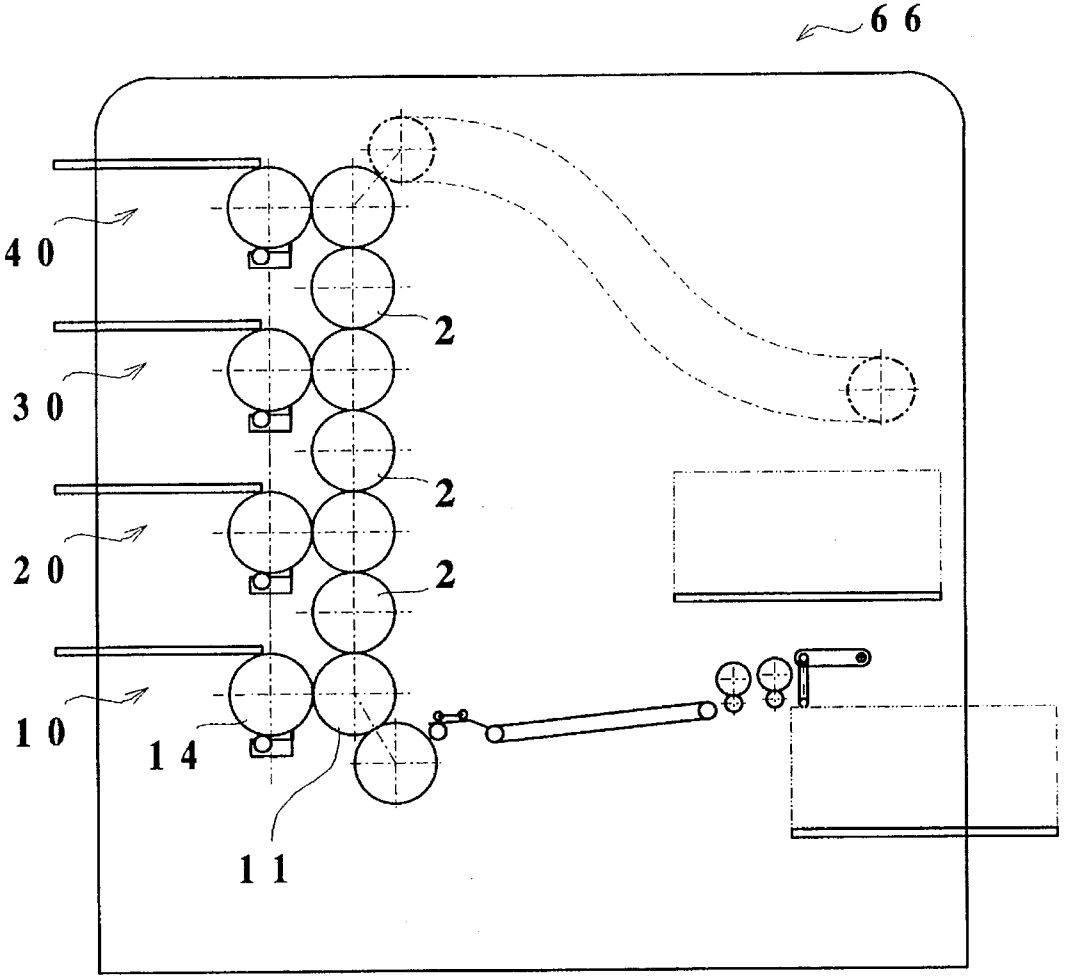
FIG. 6 is a schematic view of a gravure press 66 as another embodiment of this invention.
Figure 7A:
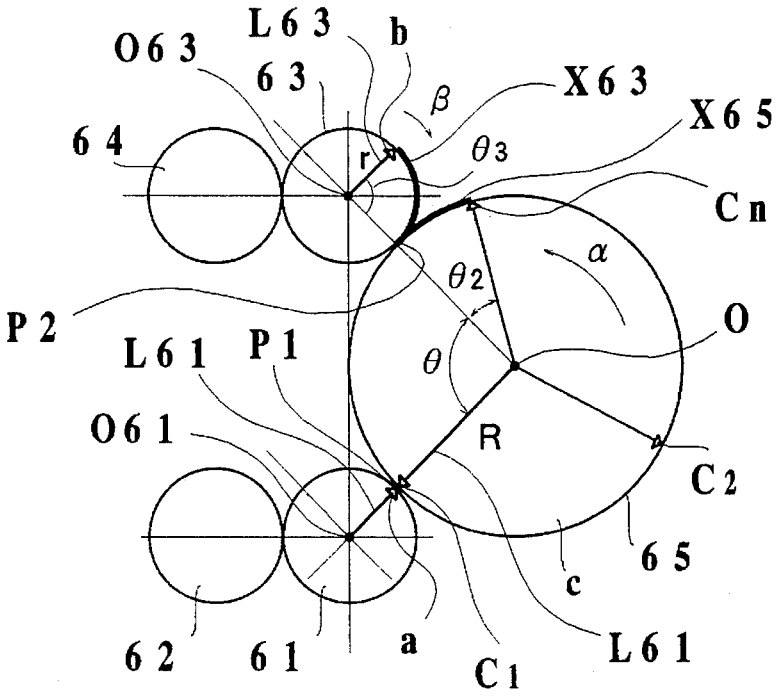
FIG. 7A is a view for disclosing the relationship between the impression cylinder and the transfer drum.
Figure 7B:
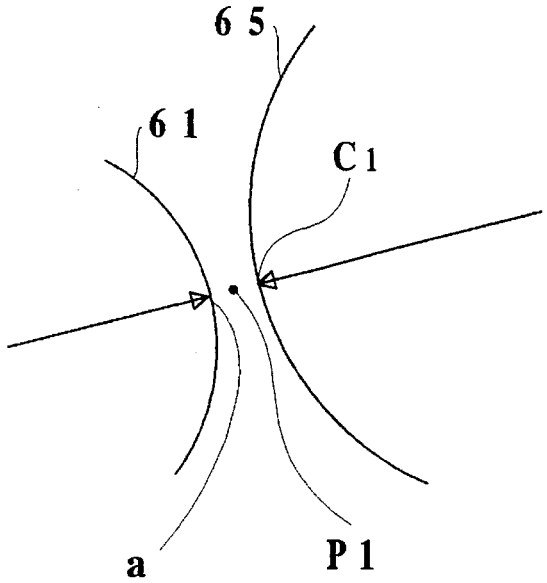
FIG. 7B is a view for disclosing the nearest point 1 between the impression cylinder and the transfer drum.
Figure 7A:
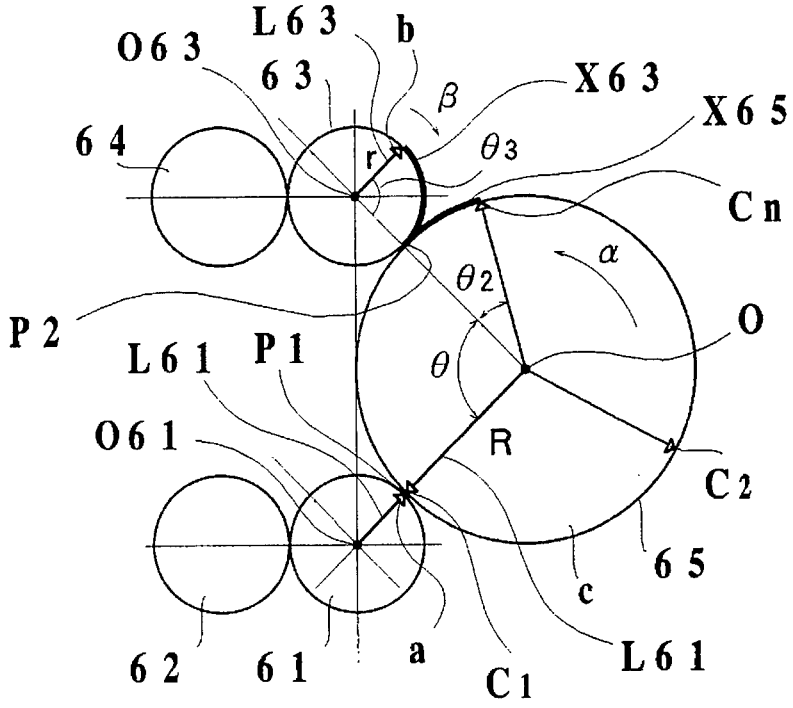
Figure 7B:
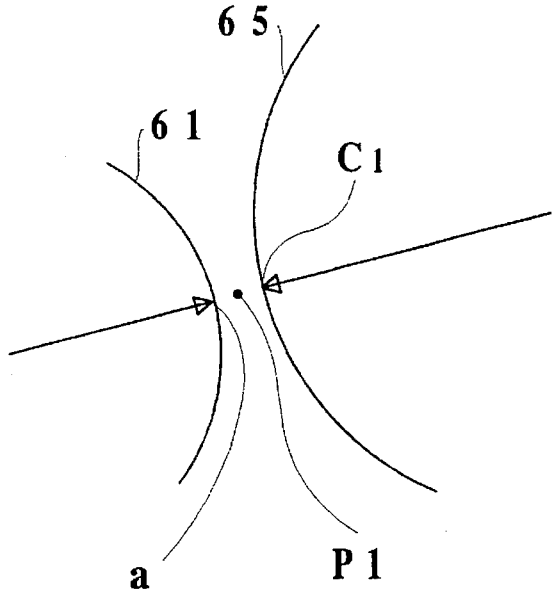

FIG. 6 shows a simplified structural view of a gravure press 66 as still another embodiment. The gravure press 66 is the same with the gravure press shown in FIG. 2 except it is provided with the first unit 10 through the fourth unit 40 to perform four-color printing. Since other structures remain unchanged, further description is omitted.

6. Other Application Examples

In the embodiments described above, the line L1 vertically connecting the axes of the plate cylinder 14 of the first unit and the impression cylinder 11 of the first unit to each other, and the line L2 vertically connecting the axes of the plate cylinder 24 of the second unit and the impression cylinder 21 of the second unit located as an upper unit above the first unit each other are both parallel to the horizontal line. However, the directional arrangement of the lines should not be limited to the above but the lines may not be parallel to the horizontal line as long as the lines are parallel to each other.

While the above embodiments are described on the two-color and four-color printing, this invention may be applied similarly to printing in larger number of colors.

While the above embodiments are described on the structures using a single- or double-radius transfer drum, a structure may also be constituted using a transfer drum having a radius which is an integer N times the radius of the impression cylinder. In that case, it is a common practice to provide N pieces of grippers on the transfer drum. However, such an arrangement should not be considered as restrictive but any other arrangements of the impression cylinders 11, 21 and the transfer drum 2 may be employed, as long as a paper sheet is transferred by the rotation of the transfer drum 2 from the nearest point $P_1$ between the impression cylinder 11 of the first unit and the transfer drum 2 to the nearest point $P_2$ between the impression cylinder 21 of the second unit and the transfer drum 2.

In the gravure press constituted according to this invention, the plate cylinders and the impression cylinders are of an identical radius, and the plate cylinders and the impression cylinder are arranged so that the line vertically connecting the axes of the plate cylinder of an attention unit and the impression cylinder of the attention unit to each other is parallel to the line vertically connecting the axes of the plate cylinder of a upper unit located adjacent above the attention unit and the impression cylinder of the upper unit to each other. Therefore, all the units are in phase agreement. This makes it possible to prevent all the doctor blades from stopping on printing surfaces of gravure plates and to prevent plastic printing surfaces from being damaged only when the printing press is stopped so that any one of the blades stops at a location other than the location on the printing surface of a gravure plate.

The impression cylinder of the attention unit described above, the impression cylinder of the upper unit described above, and the transfer drum located between those two impression cylinders are arranged so that a paper sheet transferred at the nearest point between the impression cylinder of the attention unit and the transfer drum of the unit located adjacent above the attention unit is securely transferred at the nearest point between the impression cylinder of the upper unit described above and the transfer drum when the transfer drum rotates by the number of turns obtained by dividing the radius of the transfer drum by the radius of the impression cylinder. Therefore, the paper sheet is securely transferred from then impression cylinder of the attention unit to the impression cylinder of the upper unit.

As described above, since the gravure press according to this invention is constituted so that all the units are in phase agreement and that a paper sheet is securely transferred from the impression cylinder of a attention unit to the impression cylinder of an upper unit, the plastic gravure plate is prevented from being damaged.

The gravure press according to this invention is constituted as follows: the radius of the transfer drum is an integer N times the radius of the impression cylinder; the grippers are provided in the number N and equally distributed along the circumference of the transfer drum; grippers of all the units are arranged so that, when a gripper is on the line vertically connecting the axes of the impression cylinder of the attention unit and the transfer drum each other, the gripper is on the line vertically connecting the axes of the impression cylinder of the upper unit and the transfer drum; and, the impression cylinder of the attention unit, the impression cylinder of the upper unit, and the transfer drum between the two cylinders are arranged so that the angle θ described above is expressed by the equation $\theta=2\pi/(N+1)$.

Therefore, a paper sheet is also securely transferred from the impression cylinder of the attention unit to the impression cylinder of the upper unit by using the transfer drum on which the grippers are provided in the number N distributed along the circumference of the transfer drum at equal intervals.

This makes it possible to provide a gravure press capable of preventing a plastic gravure plate from being damaged.

Furthermore, in the gravure press according to this invention, state of the ink stored in the concave pattern is less likely to change and the printing is stabilized because each of the blades is located at the same relative position on each unit, with the position being in the vicinity of the nearest point between the plate cylinder and the impression cylinder, and on the underside of the plate cylinder. Furthermore, since the distance between the blade and the nearest point is identical for all the units, the ink drying conditions on all the units are made identical to obtain prints of identical quality. This makes it possible to provide a gravure press capable of reducing scatter in printing quality.

Furthermore, since the means for receiving the paper sheets to be printed and the means for receiving the printed paper sheets are located on the same side, the paper sheets to be printed and the printed paper sheets are placed on the same side of the gravure press according to this invention. This provides a gravure press capable of making the operations of loading and unloading the paper sheets easy.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A gravure press comprising:

a group of units including at least adjacent first and second units, the second unit being above the first unit, said group of units including at least one unit positioned at an end of said group of units;

each of said group of units comprising a plate cylinder, an impression cylinder, ink feeder means, and a blade;

each of said plate cylinders having a plastic gravure plate wound thereon;

each of said impression cylinders having a radius equal to a radius of each of said plate cylinders and having a transfer gripper for transferring printing paper sheets;

each of said ink feeder means supplying ink to a respective gravure plate;

each said blade positioned to be in contact with a respective gravure plate for removing surplus ink adhering to said gravure plate;

a transfer drum between each of said impression cylinders of adjacent units and having a radius being an integer times the radius of said impression cylinders, said transfer drum having at least one transfer gripper device for transferring paper sheets for printing;

said plate cylinders and impression cylinders being arranged so that a first line vertically connecting the axes of the plate cylinder and the impression cylinder of said first unit is parallel to a second line vertically connecting the axes of the plate cylinder and the impression cylinder of the second unit;

said impression cylinder of said first unit, said impression cylinder of said second unit, and said transfer drum being positioned relative to one another such that a paper sheet transferred at a nearest point between said impression cylinder of said first unit and said transfer drum is transferred at a nearest point between said impression cylinder of said second unit and said transfer drum, the paper sheet being transferred when said impression cylinder of said first unit rotates by a number of turns equal to the radius of said transfer drum divided by the radius of said impression cylinder of said first unit;

first receiving means for receiving paper sheets to be printed;

second receiving means for receiving printed paper sheets on which printing is performed, said second receiving means and said first receiving means being positioned on a same side of the gravure press;

means for feeding paper sheets received in said first receiving means to said one unit; and means for transferring printed paper sheets from said one unit to said second receiving means.

2. A gravure press according to claim 1, wherein:

the radius of said transfer drum is an integer N times the radius of each of said impression cylinders, a plurality of transfer gripper devices are positioned at equal intervals along the circumference of said transfer drum; and said transfer gripper of said impression cylinder of said first unit, said impression cylinder of said second unit, and said transfer drum are positioned as follows:

said transfer gripper of each of said units is arranged so that, when said transfer gripper device is on said first line, said transfer gripper of each of said units is on said second line;

a nearest point between the impression cylinder of said first unit and said transfer drum is a first nearest point a nearest point between the impression cylinder of said second unit and said transfer drum is a second nearest point a center of said transfer drum is 0; and an angle $P_1OP_2$ formed by said nearest point $P_1$, axial center 0, and nearest point $P_2$ is an angle θ, the angle θ being equal to $2\pi/(N+1)$.

3. A gravure press according to claim 1, wherein said end is a lowermost end.

4. A gravure press according to claim 2, wherein said end is a lowermost end.

5. A gravure press according to claim 3, wherein each said ink feeder means is positioned under a respective plate cylinder; and each said blade is positioned in a lower portion of a respective plate cylinder, proximate to said nearest point of a respective plate cylinder and impression cylinder, and at an identical position on each of said units.

6. A gravure press according to claim 4, wherein each of said ink feeder means is positioned under a respective plate cylinder; and each said blade is positioned in a lower portion of a respective plate cylinder, proximate to said nearest point of a respective plate cylinder and impression cylinder, and at an identical position on each of said units.

7. A method for constructing a gravure press comprising:

(a) providing a group of units including at least adjacent first and second units, the second unit being above the first unit, said group of units including at least one unit positioned at an end of said group of units, each of said group of units comprising a plate cylinder, an impression cylinder, ink feeder means, and a blade;

(i) providing each of said plate cylinders with a plastic gravure plate wound thereon;

(ii) providing each of said impression cylinders with a radius equal to a radius of each of said plate cylinders and a transfer gripper for transferring printing paper sheets;

(iii) providing each of said ink feeder means with ink to supply to a respective gravure plate;

(iv) positioning each said blade to be in contact with a respective gravure plate for removing surplus ink adhering to said gravure plate;

(b) positioning a transfer drum between each of said impression cylinders of adjacent units, the transfer drum having a radius being an integer times the radius of said impression cylinders, said transfer drum having at least one transfer gripper device for transferring paper sheets for printing;

(c) arranging said plate cylinders and impression cylinders so that a first line vertically connecting the axes of the plate cylinder and the impression cylinder of said first unit is parallel to a second line vertically connecting the axes of the plate cylinder and the impression cylinder of the second unit;

(d) arranging said impression cylinder of said first unit, said impression cylinder of said second unit, and said transfer drum so that a paper sheet transferred at a nearest point between said impression cylinder of said first unit and said transfer drum is transferred at a nearest point between said impression cylinder of said second unit and said transfer drum, (i) the paper sheet being transferred when said impression cylinder of said first unit rotates by a number of turns equal to the radius of said transfer drum divided by the radius of said impression cylinder of said first unit;

(e) providing a first receiving means for receiving paper sheets to be printed;

(f) providing a second receiving means for receiving printed paper sheets on which printing is performed;

(g) positioning said second receiving means and said first receiving means on a same side of the gravure press;

(h) providing means for feeding paper sheets received in said first receiving means to said one unit; and (i) providing means for transferring printed paper sheets from said one unit to said second receiving means.

8. A method for constructing a gravure press according to claim 7, wherein:

the radius of said transfer drum is an integer N times the radius of each of said impression cylinders, a plurality of transfer gripper devices being positioned at equal intervals along the circumference of said transfer drum; and the method further comprising, determining a position of said transfer gripper of said impression cylinder of said first unit, said impression cylinder of said second unit, and said transfer drum by:

arranging said transfer gripper of each of said units so that, when said transfer gripper device is on said first line, said transfer gripper of each of said units is on said second line;

defining a nearest point between the impression cylinder of said first unit and said transfer drum as a first nearest point $P_1$;

defining a nearest point between the impression cylinder of said second unit and said transfer drum as a second nearest point $P_2$;

defining a center of said transfer drum as 0; and defining an angle $P_1OP_2$ formed by said nearest point $P_1$, axial center 0, and nearest point $P_2$ as angle $\theta$, the angle $\theta=2\pi/(N+1)$.

9. A method for constructing a gravure press according to claim 7, wherein said end is a lowermost end.

10. A method for constructing a gravure press according to claim 8, wherein said end is a lowermost end.

11. A method for constructing a gravure press according to claim 9, wherein each said ink feeder means is positioned under a respective plate cylinder; and each said blade is positioned in a lower portion of a respective plate cylinder, proximate to said nearest point of a respective plate cylinder and impression cylinder, and at an identical position on each of said units.

12. A method for constructing a gravure press according to claim 10, wherein each of said ink feeder means is positioned under a respective plate cylinder; and each said blade is positioned in a lower portion of a respective plate cylinder, proximate to said nearest point of a respective plate cylinder and impression cylinder, and at an identical position on each of said units.

* * * * *

UNITED STATES PATENT AND TRADEMARK OFFICE
CERTIFICATE OF CORRECTION

PATENT NO. : 5,463,949

DATED : November 7, 1995

INVENTOR(S) : Kenso Maehara, et al.

It is certified that error appears in the above-identified patent and that said Letters Patent is hereby corrected as shown below:

Column 10, line 23, insert --$P_1$; -- after "point"
Column 10, line 26, insert --$P_2$; -- after "point"

Signed and Sealed this

Twentieth Day of August, 1996

Bruce Lehman

*Attest:*

BRUCE LEHMAN

*Attesting Officer*

*Commissioner of Patents and Trademarks*